United States Patent [19]
Sievers
[11] 4,352,840
[45] Oct. 5, 1982

[54] INTERDISPERSED PHASE COATINGS METHOD

[75] Inventor: G. Kelly Sievers, Burbank, Calif.

[73] Assignee: Turbine Metal Technology, Inc., Burbank, Calif.

[21] Appl. No.: 207,246

[22] Filed: Nov. 17, 1980

[51] Int. Cl.³ ..... C23C 11/00; C23C 13/00
[52] U.S. Cl. ..... 427/252
[58] Field of Search ..... 427/248.1, 252, 253, 427/405, 409, 419.2, 372.2

[56] References Cited

U.S. PATENT DOCUMENTS

| | | | |
|---|---|---|---|
| 3,345,197 | 10/1967 | Martini et al. | 427/253 |
| 3,573,963 | 4/1971 | Maxwell | 427/419.2 |
| 3,677,789 | 7/1971 | Bungardt et al. | 427/252 |
| 3,961,910 | 6/1976 | Baladjanian et al. | 427/253 |
| 3,978,251 | 8/1976 | Stetson et al. | 427/253 |
| 4,105,512 | 8/1978 | Martens et al. | 427/250 |
| 4,156,042 | 5/1979 | Hayman et al. | 427/253 |

FOREIGN PATENT DOCUMENTS

| | | | |
|---|---|---|---|
| 2304590 | 11/1976 | France | 427/253 |

*Primary Examiner*—Norman Morgenstern
*Assistant Examiner*—S. L. Childs
*Attorney, Agent, or Firm*—Wagner & Bachand

[57] ABSTRACT

In the method of forming diffusion coatings for improved corrosion, erosion or wear properties in high performance alloy structures, the coatings being characterized by the intimate presence of an interdispersed phase material in desired amount to enhance one or more of these properties, which includes interdiffusing under non-oxidizing conditions a portion of the structure surface and an alloying element disposed therewith, such as aluminum, in a diffusion pack of predetermined composition desirable for the interdiffusion, the improvement comprising maintaining the desired amount of interdispersed phase material relatively richly concentrated within a selected pack zone corresponding to the locus of interdiffusion for intimate diffusion coating interdispersal from the pack zone in interdiffusion responsive relation and freely of varying the predetermined composition of the pack.

13 Claims, No Drawings

INTERDISPERSED PHASE COATINGS METHOD

BACKGROUND OF THE INVENTION

This invention has to do with the production of interdiffusion alloy coatings such as are employed on high performance metal parts, including turbine vanes and blades, pump parts, and other parts subject to unusual demands for erosion, corrosion and wear resistance. More particularly, the invention relates to improvements in methods of producing such coatings on a wide variety of parts, which enables the rapid, repeatable obtention of superior performance parts of individually tailored properties through the selective inclusion, in a controlled interdispersion, of refractory oxide or hard carbide material and/or elemental metal additives, which are interdispersed, i.e. exist as discrete particulate material in the interdiffusion layer, with a high degree of control as to location, concentration, and, thereby, as to properties of the final product.

It is known to form intermetallic compounds and alloys on high performance parts such as turbine vanes and blades by subjecting the surface of the part to a diffusion of one or more constituents of a diffusion pack to form an interdiffusion layer, sometimes referred to as a diffusion coating. Typically, the pack comprises the one or several metals to be diffused, frequently aluminum, aluminum oxide, a halogen source and possibly other materials depending on the particular objective of the diffusion. The pack is heated for long periods at very high temperatures, and an intermetallic compound is formed typically both outwardly and inwardly of the part original surface. This kind of coating can lead extreme corrosion resistance properties to more easily formed, less costly metals, is renewable, and otherwise provides improved properties at lower overall cost.

PRIOR ART

The following U.S. Pat. Nos. have been considered in connection with the preparation of this application: 3,345,197, 3,573,963, 3,677,789, 3,961,910, 4,070,507, 4,105,512.

U.S. Pat. No. 3,345,197, to Martini et al, teaches the incorporation by codiffusion with aluminum, of undissolved materials, or interdispersed phases such as aluminum oxide, for particular purposes involved with improvements in the properties of the final coating. To accomplish this Martini finely grinds the aluminum oxide, e.g. to a size as fine as 5 microns, and mixes the resultant "colloidal" material with aluminum to form a powder, and then heats the part in the powder to achieve an aluminide coating with interdispersed aluminum oxide, some of which has migrated out of the powder into the surface of the part. Martini is limited in his pack composition to the extremely finely ground aluminum oxide, and to the use of aluminum as the diffusing metal. No halide is used to assist in aluminum diffusion. Thus limited, the Martini method is of limited utility, although the product realized has potential.

Important among the disadvantages of Martini is the alteration of conventional pack compositions, as by requiring quantities of finely ground aluminum oxide as a necessary part of the pack, at the risk of not achieving the desired incorporation of refractory oxide material in the final coating, where the particle size is excessive. The flexibility of result in Martini is quite limited, since incorporation of the oxide from within the pack is restricted to but one value of refractory material density in the diffusion coating and that value is dependent on the original pack composition.

SUMMARY OF THE INVENTION

It is accordingly an object of the present invention to provide improvements in methods of diffusion coating whereby the desirable results of interdispersed phase are realized and without the processing disadvantages heretofore necessarily suffered. It is a further object to provide method and product which has the benefits of a wide variety of incorporated materials, with essentially conventional pack formulation, and with no critical limits on particle sizes of pack constituents. Additionally, more active packs can be used, and multiple material incorporations effected simultaneously.

These, and other objects of the invention to become apparent hereinafter, are realized in the method of forming diffusion coatings for improved corrosion, erosion or wear properties in high performance alloy structures wherein the coatings are characterized by the intimate presence of an interdispersed phase material in desired amount to enhance one or more of the properties, which includes interdiffusing under non-oxidizing conditions a portion of the structure surface and an alloying element disposed therewith in a diffusion pack of predetermined composition desirable for the interdiffusion, through the improvement comprising maintaining the desired amount of interdispersed phase material relatively richly concentrated within a selected pack zone corresponding to the locus of interdiffusion for intimate diffusion coating interdispersal from the pack zone in interdiffusion responsive relation and without varying the predetermined composition of the pack.

It will be noted that the method thus provides for obtaining special phase intermixing in conjunction with conventional pack diffusion, locally at the part surface, and without need of accommodating special composition or component size dictates which have heretofore been thought necessary to achieve like results.

In particular aspects, the invention includes: maintaining the interdispersed phase material as a adherent film at the locus at the inception of interdiffusion; maintaining a refractory oxide separate from the pack constituents and within the interdiffusion locus to form the interdispersed phase; maintaining a hard carbide separate from the pack constituents and within the interdiffusion locus to form the interdispersed phase; maintaining a metal having an atomic number of 24 or higher separate from the pack constituents and within the interdiffusion locus to form the interdispersed phase; supporting the interdispersed phase material on a substrate within the pack in relative rich concentration defining relation; having the surface define the interdispersed phase material substrate; forming a coating of the interdispersed phase material on the structure surface as the locus of interdiffusion concentration of the interdispersed phase; supporting the interdispersed phase material on the structure surface with an organic binder; forming an adherent layer of interdispersed phase material in organic liquid binder on the structure surface, and drying the binder; adhering to the structure surface at the locus of interdiffusion an interdispersed phase material selected from refractory oxides comprising zirconia, alumina, titania, magnesia, yttria, and hafnia, hard carbides comprising tungsten carbide, tantalum carbide, zirconium carbide, titanium carbide, silicon carbide, and chromium carbide, and/or adhering to the structure surface at the locus of interdiffusion an interdispersed phase material selected from the group consisting of tungsten, tantalum, molybdenum, zirconium, titanium, hafnium, yttrium, and chromium.

DESCRIPTION OF THE PREFERRED EMBODIMENTS

"Interdispersed" and its cognitives herein refer to a discrete particulate higher atomic number metal, i.e. having an atomic number of 24 or above, of a refractory oxide material, or of a hard carbide material, incorporated in a diffusion-formed alloy or intermetallic compound.

EXAMPLE I

A conventional diffusion pack comprising per 100 parts by weight, 6 parts of aluminum powder, −200 mesh, and 94 parts of aluminum oxide powder, 100 to 325 mesh, is prepared. A jet engine blade comprised of nickel superalloy of the percent composition:

| | |
|---|---|
| 0.12 | Carbon |
| 12.5 | Chromium |
| 4.2 | Molybdenum |
| 2.0 | Columbium |
| 0.8 | Titanium |
| 6.1 | Aluminum |
| 0.012 | Boron |
| 0.1 | Zirconium |
| Bal. | Nickel |

is coated with a adherent layer of 10 micron powder aluminum oxide, by painting onto the part the oxide suspended in a lacquer binder. After the binder dries, the aluminum oxide is firmly bound to the part surfaces and the part, thus coated, is immersed in the mentioned pack. The pack is heated to 1050°-1100° Centigrade, in a hydrogen atmosphere, for 4–5 hours. A second engine blade of identical composition, also placed in the pack during the heat, is also diffused but without first precoating with aluminum oxide as a Control. Microsections of the Example and Control parts are compared by microscopic examination. Comparison of the Example and Control parts reveals that each has a diffusion coating which extends both inwardly and outwardly from the nominal surface of the part before diffusion. The Example part exhibits an oxide dispersion characterized by uniform distribution of an interdispersed phase of aluminum oxide particulate, which will greatly enhance erosion resistance of the part. The Control part, on the other hand, exhibits no significant aluminum oxide interdispersed phase, and thus is unimproved in erosion resistance by the described diffusion procedure.

EXAMPLE II

Example I is duplicated using as the pack composition, in lieu of the aluminum powder in the pack, titanium powder, −200 mesh (Example IIa); boron powder, −325 mesh (Example IIb); and silicon powder, −200 mesh (Example IIc). The interdispersed material is also varied using tungsten carbide (Example IId), tantalum carbide (Example IIe), zirconium carbide (Example IIf); titanium carbide (Example IIg); silicon carbide (Example IIh); chromium carbide (Example IIi). The interdispersed material is also varied using tungsten (Example IIj), tantalum (Example IIk), molybedenum (Example IIl); zirconium (Example IIm); titanium (Example IIn); hafnium (Example IIo); yttrium (Example IIp); all powdered and held on with organic binder, and plated-on chromium (Example IIq) as the metal coating on the blade part; and in lieu of the aluminum oxide refractory coating on the part, zirconia (Example IIr); titania (Example IIs); magnesia (Example IIt); yttria (Example IIu); and hafnia (Example IIv).

The products of Examples IIa-v are improved in corrosion, erosion and/or wear performance over controls produced at the same time, but without maintaining the particular interdispersed material at the interdiffusion locus, by the expedient of coating the part surface with the interdispersed material, in advance of subjecting the part to pack diffusion. Also, it will be noted that the pack compositions need not be specially formulated, either as to constituents or particle size of constituents. The disclosed method therefore affords a product of variously improved properties with only the coating on the part to be diffused being varied, for a given pack composition.

The reason for the improvement in properties of a part diffused with an interdispersed phase over a part without such a phase appears to be that the dispersed phase can stabilize a protective oxide phase formed in part use, provide some protection against impinging particles, or change the macroscopic hardness of the coating.

The interdispersed phase may be a refractory oxide as indicated above whereby the property improvements are typically improved erosion resistance, a hard carbide whereby the property improvements are typically wear reistance, or a metal whereby the property improvements are typically in corrosion resistance.

Typical pack diffusion conditions for carrying out the present method are temperatures between 760° C. to 1100° C. and heating for 2 to 20 hours.

Suitable binders, if used, are synthetic organic polymeric materials suitably soluble in organic vehicles which will evaporate at a satisfactory rate for formation of adherent coating on a part to be diffused, or a portion of such part, where specifically varied properties are desired.

I claim:

1. In the method of forming diffusion coatings for improved corrosion, erosion or wear properties in high performance alloy structures, said coatings being characterized by the intimate presence of an interdispersed phase material in desired amount to enhance one or more of said properties, which includes interdiffusing under non-oxidizing conditions a portion of the structure surface and an alloying element disposed therewith in a diffusion pack of predetermined composition desirable for said interdiffusion, the improvement comprising maintaining said desired amount of interdispersed phase material relatively richly concentrated within a selected pack zone corresponding to the locus of interdiffusion for intimate diffusion coating interdispersal from said pack zone into said coating in interdiffusion reponsive relation, and maintaining said phase material as discrete particulate matter during said interdispersal.

2. Method according to claim 1, including also maintaining said interdispersed phase material as a adherent film at said locus at the inception of interdiffusion.

3. Method according to claim 1, including also maintaining a refractory oxide separate from said pack constituents and within said interdiffusion locus to form said interdispersed phase.

4. Method according to claim 1, including also maintaining a hard carbide separate from said pack constituents and within said interdiffusion locus to form said interdispersed phase.

5. Method according to claim 1, including also maintaining a metal having an atomic number of 24 or higher separate from said pack constituents and within said interdiffusion locus to form said interdispersed phase.

6. Method according to claim 1, including also supporting said interdispersed phase material on a substrate within said pack in relatively rich concentration defining relation.

7. Method according to claim 6, in which said structure surface defines said interdispersed phase material substrate.

8. Method according to claim 7, including also forming a coating of said interdispersed phase material on said structure surface as the locus of interdiffusion concentration of said interdispersed phase.

9. Method according to claim 8, including also supporting said interdispersed phase material on said structure surface with an organic binder.

10. Method according to claim 9, including also forming an adherent layer of interdispersed phase material in organic liquid binder on said structure surface, and drying the binder.

11. Method according to claim 10, including also adhering to the structure surface at the locus of interdiffusion an interdispersed phase material having a particle size of less than about 25 microns and selected from refractory oxides comprising zirconia, alumina, titania, magnesia, yttria, or hafnia.

12. Method according to claim 10, including also adhering to said structure surface at the locus of interdiffusion an interdispersed phase material having a particle size of less than about 25 microns and selected from the group consisting of tungsten carbide, tantalum carbide, zirconium carbide, titanium carbide, silicon carbide and chromium carbide.

13. Method according to claim 8, including also adhering to said structure surface at the locus of interdiffusion a interdispersed phase material selected from the group consisting of tungsten, tantalum, molybdenum, zirconium, titanium, hafnium, yttrium and chromium.

* * * * *